US010370865B2

(12) United States Patent
Roumagnac

(10) Patent No.: US 10,370,865 B2
(45) Date of Patent: Aug. 6, 2019

(54) AUTONOMOUS POOL CLEANING ROBOT

(71) Applicant: KOKIDO DEVELOPMENT LIMITED, Kwun Tong, Kowloon (HK)

(72) Inventor: Max Roumagnac, Martignas (FR)

(73) Assignee: KOKIDO DEVELOPMENT LIMITED, Kwun Tong, Kowloon (HK)

( * ) Notice: Subject to any disclaimer, the term of this patent is extended or adjusted under 35 U.S.C. 154(b) by 0 days.

(21) Appl. No.: 15/577,117

(22) PCT Filed: Sep. 29, 2016

(86) PCT No.: PCT/FR2016/052487
§ 371 (c)(1),
(2) Date: Nov. 27, 2017

(87) PCT Pub. No.: WO2017/060588
PCT Pub. Date: Apr. 13, 2017

(65) Prior Publication Data
US 2018/0179772 A1 Jun. 28, 2018

(30) Foreign Application Priority Data
Oct. 5, 2015 (FR) ..... 15 59447

(51) Int. Cl.
*E04H 4/04* (2006.01)
*E04H 4/16* (2006.01)
(Continued)

(52) U.S. Cl.
CPC ..... *E04H 4/1663* (2013.01); *B63H 11/04* (2013.01); *B63H 21/17* (2013.01); *E04H 4/16* (2013.01);
(Continued)

(58) Field of Classification Search
CPC ..... E04H 4/16; E04H 4/1658; E04H 4/1663
(Continued)

(56) References Cited

U.S. PATENT DOCUMENTS 5,842,243 A * 12/1998 Horvath ..... E04H 4/1636 15/1.7
6,412,133 B1 * 7/2002 Erlich ..... E04H 4/1663 15/1.7
(Continued)

FOREIGN PATENT DOCUMENTS

EP 1022411 A2 7/2000
EP 1122382 A1 8/2001
(Continued)

OTHER PUBLICATIONS

International Search Report for corresponding PCT application No. PCT/FR2016/052487, dated Apr. 20, 2017.

*Primary Examiner* — Michael D Jennings
(74) *Attorney, Agent, or Firm* — Notaro, Michalos & Zaccaria P.C.

(57) ABSTRACT

A pool cleaning robot that has a water jet electrohydraulic motorized propulsion/pump unit and a waste-collecting body having a battery for powering said unit, the unit and the battery being contained inside a rotary and sealed turret, external to the body of the robot. The robot advantageously has an automatic direction reversing device having a vane secured to the turret with a first end stop and second end stops.

20 Claims, 4 Drawing Sheets

(51) Int. Cl.
*B63H 11/04* (2006.01)
*B63H 21/17* (2006.01)

(52) U.S. Cl.
CPC ..... *E04H 4/1654* (2013.01); *B63B 2755/00* (2013.01)

(58) Field of Classification Search
USPC ..... 15/1.7
See application file for complete search history.

(56) References Cited

U.S. PATENT DOCUMENTS

| | | | | |
|---|---|---|---|---|
| 6,797,157 | B2 * | 9/2004 | Erlich | E04H 4/1636 134/168 R |
| 9,091,092 | B1 * | 7/2015 | Hui | E04H 4/1636 |
| 2004/0168838 | A1 * | 9/2004 | Erlich | E04H 4/1663 180/21 |
| 2007/0157413 | A1 * | 7/2007 | Roumagnac | E04H 4/1654 15/302 |
| 2013/0152970 | A1 * | 6/2013 | Porat | E04H 4/1654 134/18 |

FOREIGN PATENT DOCUMENTS

| | | | |
|---|---|---|---|
| EP | 1689957 | A1 | 8/2006 |
| EP | 2484847 | A1 | 8/2012 |
| EP | 2669450 | A1 | 12/2013 |
| FR | 2896005 | A1 | 7/2007 |
| WO | 2004015223 | A2 | 2/2004 |

* cited by examiner

AUTONOMOUS POOL CLEANING ROBOT

FIELD OF THE INVENTION

The present invention relates to an autonomous swimming-pool cleaning robot.

TECHNOLOGICAL BACKGROUND

In order to clean swimming pools and other pools, there exist hydraulic robots which operate using the energy of the swimming-pool filtration unit. These robots are connected either to the delivery side or to the suction side of the filtration pump by a floating line measuring 8 to 12 m.

These robots only operate correctly if the filtration installation has sufficient power. They reduce the original filtration performance and the handling and then storage of the lines is impractical.

In order to avoid these drawbacks, independent electric filtration robots that are powered by a floating electric cable have been developed. The main advantage of this type of robot, which is delivered with a low-voltage security transformer, is the ease of installation thereof since they are connected to a standard electrical socket. These autonomous robots have the advantage of operating immediately and without adjustment, this representing a clear sales argument.

A robot of this type, but cable-powered, is described by FIGS. 5A and 5B of the document FR 2 896 005. According to this design, a member for preventing the rotation of the turret to which the cable is connected, said member being fixed to the front of the rotary turret, is activated by the movement of the robot.

One of the main hazards that is encountered with electric robots in general is the tangling of the cable, it being possible, however, for this phenomenon to be limited by the trajectories of the robot being programmed, this requiring traction engines with sophisticated control electronics, however, and/or by a rotating connector that connects the electric cable to the robot or to the electricity supply of the robot.

The drawbacks with this type of robot are the handling of the floating cable, which generally measures 8 to 18 m depending on the size of the swimming pool, and the apprehension of some users with regard to the use of electricity in water.

In order to remedy these drawbacks, battery-operated wireless robots have been developed.

These robots are either powered by a floating battery, as known from document EP 1 122 382 A1, or by on-board batteries that are rechargeable out of the water, as known for example from the document EP 1 689 957 A1, or are rechargeable in the water by induction, as described in the document EP 2 669 450 A1.

These robots are often adaptations of cable-powered electric models and their cost is greater than that of the base models from which they are derived.

Moreover, electric robots are not actually very suitable for battery operation on account of the fact that some use a programmed or programmable electronic guide system with a gyroscope, inclination sensors, wall detectors and several motors: a pump motor for suction and one or two traction motors. This multiplication of the equipment consumes energy and involves high-capacity batteries.

Other robots with a more simple design use a single motor with water-jet propulsion, the direction of which is reversed by a timer, as known for example from the documents EP 2 484 847 A1 or EP 1 022 411 A1. In this case, the robot, which moves randomly, can remain stationary against a wall for a non-negligible period of its cycle while waiting for the reversal in direction. This operation thus consumes energy, this once again involving a high-capacity battery.

In order to remedy this problem, the system provided in the document FR 2 896 005 A1 provides a cable-powered electric robot in which the movement of the robot is not capable of immobilizing the turret systematically since this movement only takes place after the latter has been immobilized, meaning that the propulsion jet can sometimes rotate permanently and in this case the robot does not move.

Another principle known from the abovementioned document FR 2 896 005 A1 proposes a robot powered by a floating cable that is propelled by a rotary jet, the direction reversal of which takes place when a tilting bell cover frees a stop.

This design results in a bulky appliance since the rotary jet is contained entirely in this bell cover.

This type of appliance has high hydrodynamic resistance to movement, and this would involve a powerful pump and thus a high-capacity battery.

The invention proposes remedying these various drawbacks by proposing a battery-powered robot having a simple design with a single motor and without on-board electronics, with low hydrodynamic resistance and provided with a system that allows instantaneous reversal of the direction of movement.

BRIEF DESCRIPTION OF THE INVENTION

To this end, the present invention proposes a swimming-pool cleaning robot comprising, according to a first aspect of the invention, a water-jet electro-hydraulic propulsion unit/pump and a waste-collecting body, said robot comprising a power supply battery for said unit, the unit and the battery being contained in a leaktight rotary turret outside the body of the robot.

The unit preferably comprises an electric motor and a turbine, coupled to the electric motor by coupling means, for sucking in water that enters the body through a mouth under the robot and passes through a filter, and for delivering this water through an ejection nozzle that leads out of the turret.

The turret advantageously comprises a leaktight closure for accessing the battery.

According to an advantageous embodiment, the nozzle is positioned so as to deliver the sucked-in water in a direction substantially parallel to the bottom of the swimming pool in order for the robot to be propelled by means of the nozzle.

The turret is advantageously mounted on the body of the robot by way of a rotary connection which comprises an annular collar on the body around a hole for receiving an annular base of the turret.

According to a particular embodiment, the rotary connection comprises protuberances for clip-fastening the turret to the body.

The suction turbine is preferably of the centrifugal turbine type and comprises an inlet to the interface between the turret and the body.

According to a particular embodiment, the inlet to the turbine at the body/turret interface is provided with a funnel-like profile.

According to a particularly advantageous embodiment, the motor is a motor with a power of less than or equal to 50 W.

According to a second aspect of the invention, the invention provides a robot comprising an automatic direction reversal device comprising a vane secured to the turret and comprising a first stop and second stops.

The vane is advantageously articulated on a pin, bears said first stop, which acts as a retractable stop, and comprises, on a side remote from the first stop with respect to the pin, a widened part which allows the vane to turn about the pin so as to cause the vane to descend again under the action of the hydrodynamic thrust that is brought about by the rotation of the turret and then by the movement of the robot and is applied to the vane.

The rising of the vane is obtained either as a result of its buoyancy with the robot at a standstill or, with the turret rotating, by the force exerted between the stops under the effect of the rotary torque of the turret.

The pin for receiving the vane is preferably fixed in the lower part of the turret such that, when the vane is inclined towards the horizontal on account of a rotary movement of the turret or a movement of the robot, the first stop comes into abutment against one of the second stops and such that the first stop is away from the second stops when the vane is in a vertical position with the robot and turret at a standstill.

According to a particular embodiment, the second stops are movable, an offset of one or both stops by an angle on the body of the robot with respect to the axis of movement defined by the wheels making it possible to skew the flow of water exiting the nozzle to a greater or lesser extent with respect to the axis of movement defined by the orientation of the wheels and to bend the trajectory of the robot to a greater or lesser extent.

The nozzle is advantageously off-centre on the turret such that the thrust force is exerted along an axis that forms an angle with a main axis of the robot defined by the orientation of the wheels of the robot.

According to a particular embodiment, the robot comprises a circular body in the middle of which the turret is centred.

The robot can notably comprise three wheels that point in parallel directions.

Alternatively, the robot can comprise two wheels and a roller.

In order to avoid a situation in which the robot is immobilized on a break in the gradient of the pool bottom, the bottom of the robot can comprise at least one relief that is positioned under the robot on the axis of movement of the robot.

The front roller or wheel can also be mounted on a pivoting axle.

According to a particular embodiment, the robot can comprise a floating solar panel for recharging the battery, said solar panel being connected to the propulsion unit by an electric cable with a length slightly greater than the depth of the swimming pool.

BRIEF DESCRIPTION OF THE DRAWINGS

Further features and advantages of the invention will become apparent from reading the following description of a nonlimiting exemplary embodiment of the invention with reference to the drawings, in which.

DETAILED DESCRIPTION OF EMBODIMENTS OF THE INVENTION

Figure 1:
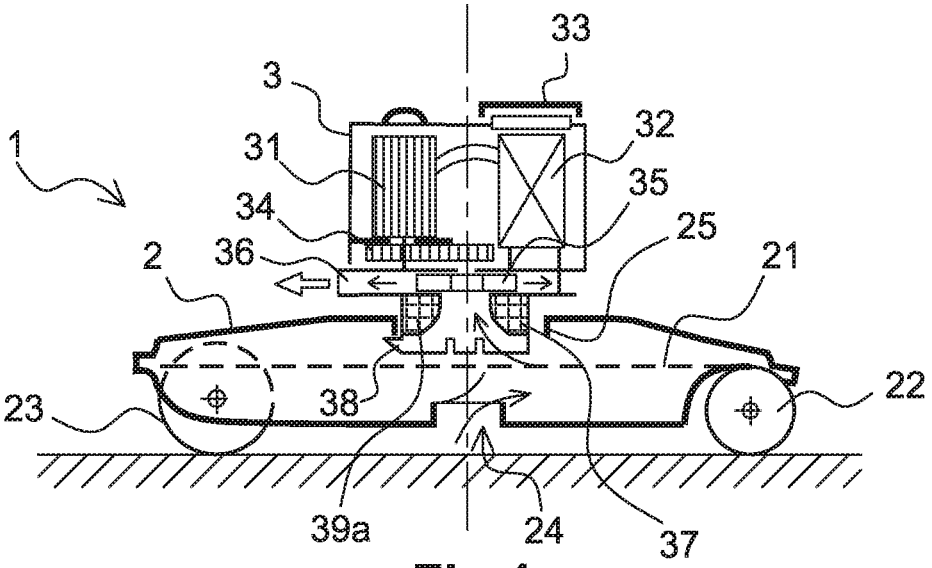
FIG. 1 shows a cross-sectional side view of a robot according to a first aspect of the invention.

According to FIG. 1, in a first aspect of the robot 1 according to the present invention, said robot comprises a water-jet electro-hydraulic propulsion unit/pump 31, 34, 35 and its power supply battery 32, these being contained in a leaktight rotary turret 3 outside the body 2 of the robot, which for its part contains the device for collecting debris in the form of a filter 21 above a vessel provided with a water inlet opening 24 under the robot.

The unit comprises an electric motor 31, reduction pinions 34 and a turbine 35, the function of which is to suck in the water which enters through the mouth 24 and passes through the filter 21, and to deliver it through an ejection nozzle 36 that leads out of the turret 3.

This design has the advantage of not reducing the useful volume for collecting debris in the main body of the robot by the presence of a battery or a motor, and of locating the electrical connections between the battery and the unit only in the turret, thereby avoiding the use of rotating electric connectors.

In order to access the battery and change it for example, the turret comprises a leaktight closure 33 that is screwed or clip-fastened.

The propulsion unit/pump therefore collects debris by way of the filter 21 in the main body and delivers the sucked-in water through the nozzle 36 in a direction substantially parallel to the bottom of the swimming pool, in order to propel the robot.

Figure 3:
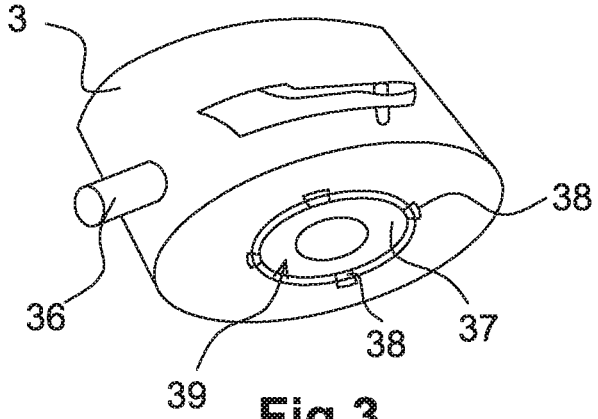
FIG. 3 shows a perspective view of a turret of a robot according to the invention.

The turret 3 is mounted on the body 2 of the robot by a rotary connection that is realized here by an annular collar 25 on the body 2 around a hole for receiving an annular base 37 of the turret. As shown in FIG. 3, this rotary connection can simply comprise clip-fastening protuberances 38 that are snap-fastened under the annular collar 25, thereby allowing standard replacement of the turret by the user without it being necessary to disconnect an electric connector, which is a frequent source of leaktightness problems.

Figure 4:
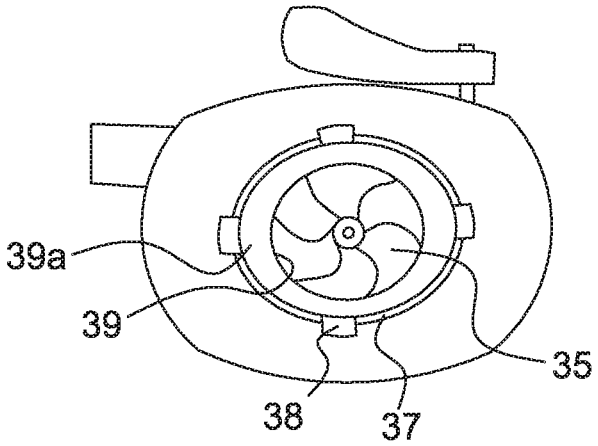
FIG. 4 shows a bottom view of the turret from FIG. 3.

According to FIG. 4, under the turret, at the interface between the turret and the body, there is an inlet 39 to the suction turbine 35 of the centrifugal turbine type, and the invention makes it possible to have a short hydraulic circuit between the turbine and the propelling nozzle 36 at the turbine outlet. The inlet 39 is provided here with a funnel-like profile 39*a* that favours suction.

The turret comprises easy access to the battery through the closure 33, thereby making it possible for said battery to be recharged and replaced by the user either in order to increase autonomy with the use of an additional battery or to change a battery at the end of its life.

This optimization of the design makes it possible to produce energy-efficient robots with a motor with a power limited to 50 W, as opposed to 150 to 200 W for known electric robots, a limited capacity battery and a reduced cost compared with currently known battery-operated robots, giving rise to a reduction in the weight of the propulsion/pump device to 2 kg, as opposed to 6 to 10 kg for traditional robots.

Figure 2:
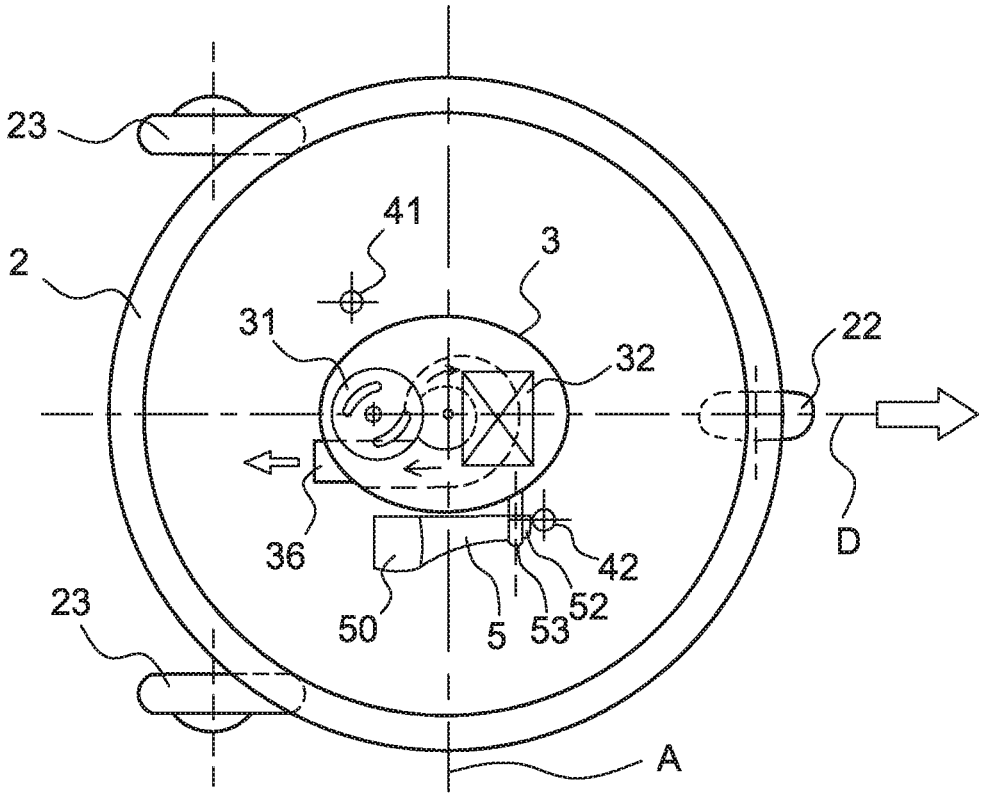
FIG. 2 shows a top view of the robot from FIG. 1.

According to FIG. 2, the robot comprises a circular body in the middle of which the turret 3 is centred. The robot comprises three wheels that point in parallel directions, a front wheel 22 in the direction of movement depicted in FIG. 2 and two rear wheels 23. The wheels are positioned at 120° on the body here.

The nozzle 36 is slightly off-centre with respect to a straight line passing through the front wheel 22 and the centre of the turret 3 so as to give the robot a lateral thrust component which will be explained later. Similarly, the outlet axis of the nozzle is off-centre with respect to the rotation axis of the turret.

According to a second aspect of the invention, the robot is provided with an automatic direction reversal device that comprises a vane 5 secured to the turret and to protrusions 41, 42 on the body of the robot, as shown notably in FIG. 2.

The reversal device is designed to be lightweight, afford little resistance to the forward movement of the robot and have low inertia. This device is designed to free the rotation of the turret and then to immobilize it in an opposite direction as soon as the robot stops moving, so as to prevent the latter from being immobilized against a wall.

To this end, the device is designed such that the immobilization of the rotation of the turret is implemented by the rotation of the turret itself and not by the movement of the robot, resulting in a very reliable self-immobilizing system.

Figure 7A:
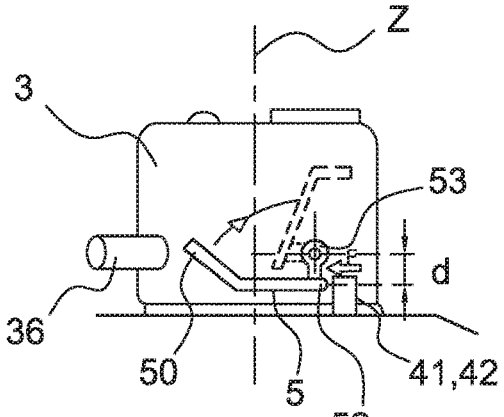
FIGS. 7A and 7B show side views of a turret according to one embodiment of the invention in two operating phases.
Figure 7B:
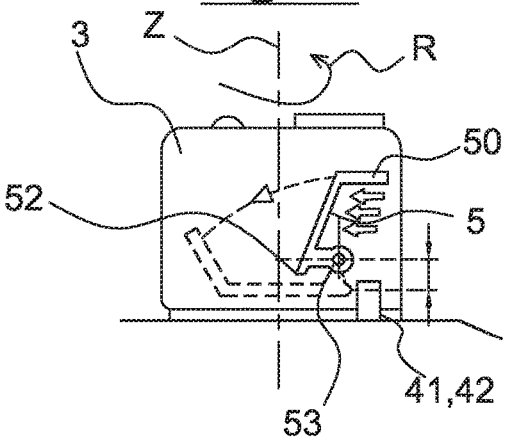

According notably to FIGS. 7A and 7B, the immobilizing device comprises a lateral vane 5 that is articulated on a pin 53 and bears a first stop 52 which acts as a retractable stop.

On a side remote from the first stop 52 with respect to the pin 53, the vane comprises a widened and possibly curved part 50 that will allow the vane to rotate about the pin 53, either causing the widened part 50 of the vane to rise on account of its buoyancy with the robot at a standstill or, with the robot moving, causing it to descend again under the action of the hydrodynamic thrust that is brought about by the movement of the robot and is applied to the vane. The widened part behaves like a lever moving the first stop 52 about the pin 53.

Figure 5:
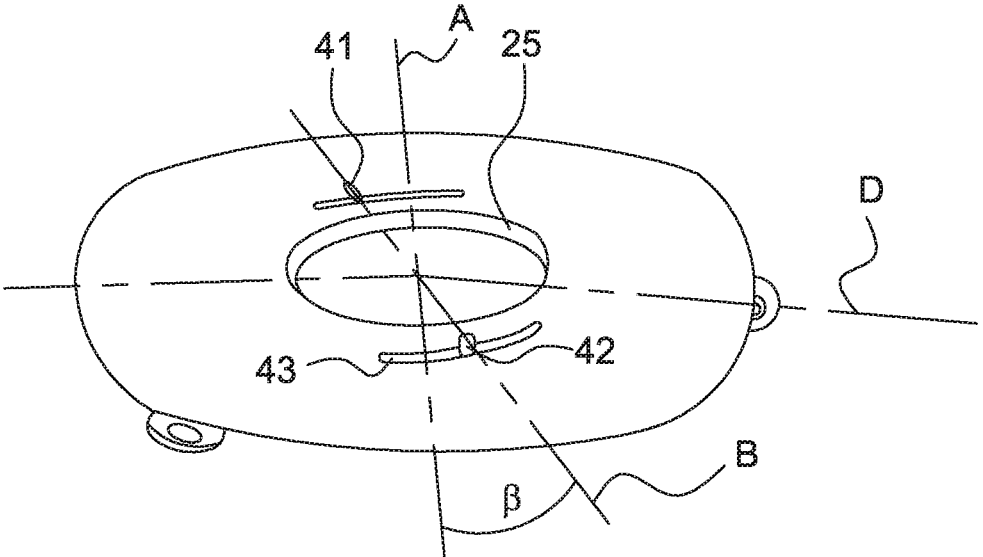
FIG. 5 shows a perspective top view of a robot body according to one particular embodiment.
Figure 6A:
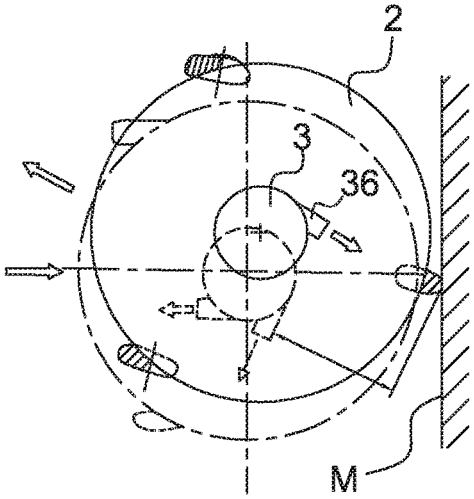
FIGS. 6A and 6B show top views of the movement of a robot according to the invention.
Figure 6B:
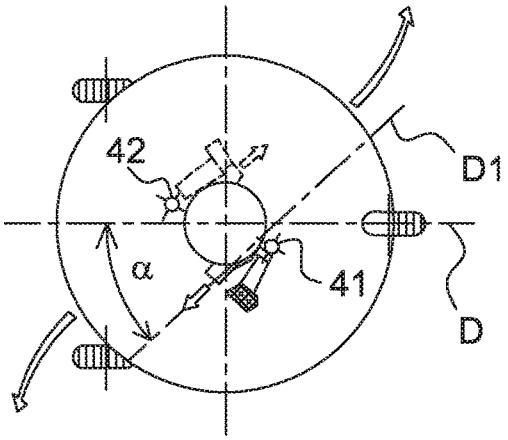

The pin for receiving the vane is fixed in the lower part of the turret such that, when the vane is inclined towards the horizontal on account of a rotary movement of the turret or a movement of the robot, the first stop 52 comes into abutment against one of a pair of second stops 41, 42 that are shown in top views in FIGS. 2, 5 and 6B and side views in FIGS. 7A and 7B.

By contrast, the first stop and the pin are positioned such that the first stop is away from the second stops when the vane is in a vertical position with the robot and turret at a standstill.

As shown in FIG. 6A, the turret provided with the propulsion unit/pump is subjected to a rotary force by the permanent torque created by the off-centre delivery by the nozzle 36.

Faced with an obstacle such as the wall M, the vane rises, the first stop moves away from a second stop and the turret starts to rotate.

In the absence of an obstacle, as in FIG. 6B, the misalignment and eccentricity of the turret with the abutting device creates a curved trajectory for the robot, the thrust force exerted along an axis D1 forming an angle $\alpha$ with the main axis D defined by the orientation of the wheels of the robot. The same goes when the robot moves in reverse when the turret has turned through 180° and the first stop is in contact with the second second stop.

As was seen above, when the robot moves, the vane is pushed from the position in FIG. 7B by the flow of water brought about by the movement to a horizontal position shown in FIG. 7A, in which the first stop 52 is retained by one of the second stops 41, 42 that is borne by the robot body and is positioned on an axis perpendicular to the movement axis with respect to the centre of the turret, thereby immobilizing the rotation of the turret.

When the robot is at a standstill, the absence of a flow of water allows the vane, which has a density less than the density of the water, to rise towards the vertical position in FIG. 7B, thereby freeing the stops and allowing free rotation of the turret that bears the propulsion unit/pump.

From the very start of this rotation, and before the movement resumes, the hydrodynamic thrust created by the rotation of the turret 3 acts on the vane 5, which tilts towards the horizontal position, thereby positioning the first stop 52 in a position of contact with the second stop 41, 42 that is secured to the body of the robot, the contact between the two stops causing the rotation to stop. In this position, the delivery by the unit is then more or less along the axis of the wheels and the robot moves in a first direction. The lever effect on the vane 5 that is brought about by the rotation is then instantaneously replaced by that associated with the movement, this keeping the stops immobilized.

When the robot encounters an obstacle, a wall or the like, the hydrodynamic thrust disappears, and the rotary torque of the turret creates, by way of the contact between the first stop 52 and one of the second stops 41, 42, a lever effect F on account of the distance d between the axis 53 and the end of the stop 52, which causes the vane to tilt forwards, as shown by the arrow in FIG. 7A, thereby freeing the first stop from the second stop 41, allowing the rotary movement to resume and the vane to tilt towards the rear, and pre-positions the first stop so as to meet the diametrically opposite second second stop 42.

The rotation of the unit stops in contact with the second stop, the delivery then takes place along the axis of the wheels and the robot then moves in a direction substantially opposite to the first direction (forward motion/reverse motion).

When the robot comprises three wheels of which the axes are fixed and parallel, the change in trajectory of the robot is ensured by the robot skidding during the rotation of the turret, the robot being in contact with a wall in the offset example in FIG. 6A. Specifically, during the rotation of the turret, the propulsion jet passes through a position perpendicular to the axis of the wheels, thereby causing at least one wheel of the robot to skid.

Moreover, according to the example in FIG. 5, where the second stops 41, 42 are movable, for example on a rotating annular plate, and jut out through slots 43, an offset of one or both stops by an angle on the body of the robot with respect to the axis of movement defined by the wheels makes it possible to skew the flow of water exiting the nozzle to a greater or lesser extent with respect to the axis of movement defined by the orientation of the wheels and to bend the trajectory of the robot to a greater or lesser extent in order to adapt it to swimming pools with particular shapes and avoid repeating routes.

Instead of the slots, it is possible to produce a plurality of positioning points for positioning the second stops, such as housings for these stops in the upper surface of the body 2.

The misalignment of the nozzle with respect to the direction of the wheels also makes it possible to reduce the speed of movement to an equivalent suction power for greater efficiency of the robot.

Figure 8:
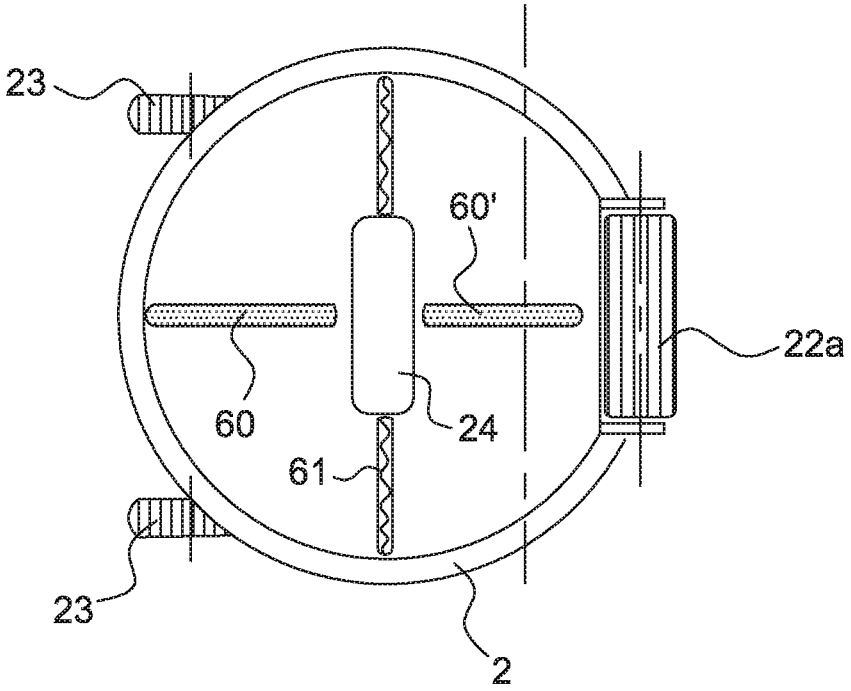
FIG. 8 shows a bottom view of a variant of the robot according to the invention.

According to a particular embodiment in FIG. 8, which shows a bottom view of the robot, the front wheel of the robot can be replaced by a roller 22*a* that provides a greater surface area of contact with the bottom of the pool so as to limit lateral slippage of the robot during the rotation of the turret.

This figure shows sweepers 61 on either side of the mouth 24 for sucking in waste.

Figure 9:
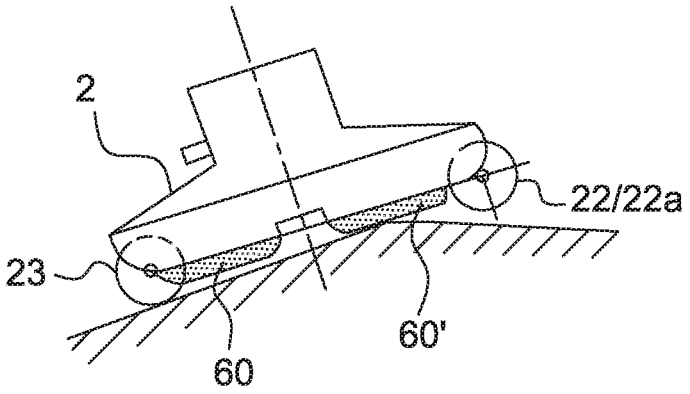
FIG. 9 shows a side view of an embodiment of the robot according to the invention on a swimming pool bottom with a break in gradient.

Reliefs 60, 60' that are realized in the example by ribs on the bottom of the body 2 form sliders, so to speak, that are positioned along the axis of movement so as to limit the surface area of contact between the lower part of the robot and the bottom of the swimming pool at an edge where there is a change in gradient and to prevent the risk of immobilization at this edge, as shown in FIG. 9.

According to additional or alternative embodiments, the front roller or wheel can be mounted on a pivoting axle, lateral deflectors can be fixed to the main body of the robot so as to provide resistance to the lateral movement of the robot and reduce skidding, the battery can be recharged by way of a floating solar panel connected to the propulsion unit by an electric cable with a length slightly greater than the depth of the swimming pool. Charge regulation of the battery starts up the robot as soon as the charge is optimal.

In order to eliminate the risks associated with a lack of leaktightness, the motor can drive the turbine by magnetic coupling rather than a set of pinions.

The invention is not limited to the example shown and notably the automatic direction reversal device having a vane 5 and stops can be applied to other types of robot, such as hydraulic robots.

The invention claimed is:

1. Swimming-pool cleaning robot (1) comprising a water-jet electro-hydraulic propulsion unit/pump (31, 34, 35) and a waste-collecting body (2), the robot comprising a power supply battery (32) for said unit, the unit and the battery being contained in a leaktight rotary turret (3) outside the body (2) of the robot, the turret (3) being mounted on the body (2) of the robot by way of a rotary connection.

2. Robot (1) according to claim 1, wherein the unit comprises an electric motor (31) and a turbine (35), coupled to the electric motor by coupling means (34), for sucking in water that enters the body through a mouth (24) under the robot and passes through a filter (21), and for delivering this water through an ejection nozzle (36) that leads out of the turret (3).

3. Robot (1) according to claim 2, wherein the nozzle is positioned so as to deliver the sucked-in water in a direction substantially parallel to the bottom of the swimming pool in order for the robot to be propelled by means of the nozzle (36).

4. Robot (1) according to claim 2, wherein the suction turbine (35) is of the centrifugal turbine type and comprises an inlet to the interface between the turret and the body.

5. Robot (1) according to claim 4, wherein the inlet (39) is provided here with a funnel-like profile (39*a*).

6. Robot (1) according to claim 2, wherein the electric motor is a motor with a power of less than or equal to 50 W.

7. Robot (1) according to claim 2, comprising wheels and wherein the nozzle (36) is off-centre on the turret such that the thrust force is exerted along an axis (D1) that forms an angle (a) with a main axis (D) of the robot defined by the orientation of the wheels of the robot.

8. Robot (1) according to claim 1, wherein the turret comprises a leaktight closure (33) for accessing the battery.

9. Robot (1) according to claim 1, wherein the rotary connection comprises an annular collar (25) on the body (2) around a hole for receiving an annular base (37) of the turret.

10. Robot (1) according to claim 9, wherein the rotary connection comprises protuberances (38) for clip-fastening the turret to the body.

11. Robot (1) according to claim 1, comprising an automatic direction reversal device comprising a vane (5) secured to the turret and comprising a first stop (52) and second stops (41, 42).

12. Robot (1) according to claim 11, wherein the vane (5) is articulated on a pin (53), bears said first stop (52), which acts as a retractable stop, and comprises, on a side remote from the first stop (52) with respect to the pin (53), a widened part (50) which allows the vane to turn about the pin (53) so as to cause the vane to descend again under the action of the hydrodynamic thrust that is brought about by the rotation of the turret and then by the movement of the robot and is applied to the vane.

13. Robot (1) according to claim 12, wherein the pin for receiving the vane is fixed in the lower part of the turret such that, when the vane is inclined towards the horizontal on account of a rotary movement of the turret or a movement of the robot, the first stop (52) comes into abutment against one of the second stops (41, 42) and such that the first stop is away from the second stops when the vane is in a vertical position with the robot and turret at a standstill.

14. Robot (1) according to claim 11, comprising wheels and wherein the second stops (41, 42) are movable, an offset of one or both stops by an angle (β) on the body of the robot with respect to the axis of movement defined by the wheels making it possible to skew the flow of water exiting the nozzle to a greater or lesser extent with respect to the axis of movement defined by the orientation of the wheels and to bend the trajectory of the robot to a greater or lesser extent.

15. Robot according to claim 1, wherein the body (2) is circular and the turret (3) is centred in the middle of the body (2).

16. Robot (1) according to claim 1, comprising three wheels (22, 23) that point in parallel directions.

17. Robot (1) according to claim 16, wherein the front roller or wheel is mounted on a pivoting axle.

18. Robot (1) according to claim 1, comprising two wheels (23) and a roller (22*a*).

19. Robot (1) according to claim 1, comprising at least one relief (60, 60') that is positioned under the robot on the axis of movement of the robot.

20. Robot (1) according to claim 1, comprising a floating solar panel for recharging the battery, said solar panel being connected to the propulsion unit by an electric cable with a length slightly greater than the depth of the swimming pool.

* * * * *